US006272991B1

(12) United States Patent
Rich et al.

(10) Patent No.: US 6,272,991 B1
(45) Date of Patent: Aug. 14, 2001

(54) METHOD FOR PRINTING A MULTI-PLY LABEL

(75) Inventors: Benny R. Rich, Oakwood; Mark D. Davis, Alpharetta, both of GA (US)

(73) Assignee: Dittler Brothers Incorporated, Atlanta, GA (US)

( * ) Notice: Subject to any disclaimer, the term of this patent is extended or adjusted under 35 U.S.C. 154(b) by 0 days.

(21) Appl. No.: 09/339,698

(22) Filed: Jun. 24, 1999

Related U.S. Application Data

(62) Division of application No. 08/514,298, filed on Aug. 11, 1995, now Pat. No. 5,944,355.

(51) Int. Cl.[7] ..... B41M 3/14
(52) U.S. Cl. ..... 101/485; 101/490
(58) Field of Search ..... 283/81; 273/288; 101/483, 66, 70, 72, 130, 212, 216, 490, 492, DIG. 43, 485

(56) References Cited

U.S. PATENT DOCUMENTS

| | | | | |
|---|---|---|---|---|
| 2,812,957 | | 11/1957 | Sarlund | 283/101 |
| 3,900,219 | | 8/1975 | D'Amato et al. | 283/901 |
| 3,994,089 | | 11/1976 | Schwartz | 40/301 |
| 4,033,611 | | 7/1977 | Johnsen | 283/101 |
| 4,174,857 | | 11/1979 | Koza | 273/139 |
| 4,398,708 | * | 8/1983 | Goldman et al. | 270/18 |
| 4,621,837 | | 11/1986 | Mack | 283/105 |
| 4,778,153 | | 10/1988 | Bachman et al. | 283/101 |
| 4,821,439 | | 4/1989 | Wilck | 283/105 |
| 4,893,559 | * | 1/1990 | Sillars | 101/216 |
| 5,076,613 | | 12/1991 | Kovacks | 283/81 |
| 5,127,676 | | 7/1992 | Bockairo | 283/81 |
| 5,198,276 | | 3/1993 | Nakajima | 428/43 |
| 5,263,743 | | 11/1993 | Jones | 283/105 |
| 5,520,760 | | 5/1996 | Freedman | 156/152 |
| 5,653,473 | | 8/1997 | Laszutko et al. . | |
| 5,667,250 | * | 9/1997 | Behm et al. | 283/102 |
| 5,772,510 | * | 6/1998 | Roberts | 463/17 |

FOREIGN PATENT DOCUMENTS

| | | | |
|---|---|---|---|
| 998978 | 1/1952 | (FR) | 283/903 |

OTHER PUBLICATIONS

Sample McDonald's "Splash for Cash" Game Stamp (copyright 1988).

* cited by examiner

*Primary Examiner*—Daniel J. Colilla
(74) *Attorney, Agent, or Firm*—Dean W. Russell; Geoff L. Sutcliffe; Kilpatrick Stockton LLP

(57) ABSTRACT

A multi-ply promotional label having a detachable game piece according to the present invention includes peripheral and perforation geometry that reduces the likelihood of intentional or inadvertent premature viewing of game indicia on the detachable piece. The label, moreover, may include multiple detachable game pieces. Deleterious effects of increased tensile stress along perforations due to the presence of multiple detachable game pieces or other factors are overcome by applying an adhesive to removably couple a preselected region of a downwardly facing aspect of a detachable game piece to an underlying base ply. The upward face of the same base ply may be printed to increase the available printable area in order, for example, to further instruct players on game procedures. Game security is enhanced and other advantages are provided by printing preselected fields containing categorical game indicia using a repetitive printing process and printing in registry therewith preselected fields containing conditional game indicia. In contrast to known processes, resulting game pieces can be produced having no predictability.

8 Claims, 9 Drawing Sheets

METHOD FOR PRINTING A MULTI-PLY LABEL

This application is a division of U.S. application Ser. No. 08/514,298 filed Aug. 11, 1995, now U.S. Pat. No. 5,944, 355.

FIELD OF THE INVENTION

This invention relates to multi-ply labels and more particularly to three-ply labels comprising promotional game pieces.

BACKGROUND OF THE INVENTION

An existing label used in connection with promotional games includes two plies. One ply, forming the base of the label, has an underside to which a pressure-sensitive adhesive is affixed. The face of the base, by contrast, contains no adhesive. In use, the underside of the base is attached to a substrate, such as a paper beverage cup, sold in retail outlets.

The second ply similarly includes a face and an underside, with the face having promotional information and game-playing instructions printed thereon. The underside of the second ply contains three regions separated by perforations, the outer two of which contain adhesive. Between these outer regions of the underside is an intermediate region comprising the surface of the game piece, which contains information concerning the prize to be awarded for that promotion. The second ply overlays the base of the label, with the adhesive of the underside of the second ply adhering to the face of the base.

To play the promotional game, a player separates the intermediate region of the second ply from the outer regions by detaching it along the perforations. Doing so exposes the surface of the game piece containing the prize information, informing the player of the result of the promotion. However, because neither the face nor the intermediate region of the underside of the second ply contains adhesive, the detached game piece cannot thereafter be affixed to a game board or container without manual application of glue.

Even were a game piece to be made with three plies, and a two-ply game piece were to be detachable, as described at length in the following sections, a variety of security and handling problems may arise.

In particular, a two-ply game piece joined to supporting portions or rails may be expected typically to extend from the promotional label roughly in the form of a tab to permit a player more easily to detach the game piece from the label. If it were possible to pull the tab a sufficient distance away from the label (without noticeably damaging it) to permit game indicia or information on the inside of the game piece to be viewed, the integrity and commercial viability of the game would be undermined. If, for example, one were able surreptitiously and inconspicuously to sever the leading ties of perforations delineating the borders of a game piece, and then to lift the tab so that it rotates about the subsequent perforation tie to such a degree that one could peek under the tab, an incentive would be created for persons, including legitimate potential game players and others, to screen objects bearing the labels for redeemable game pieces and thus "pick the cherries."

Still other problems with label-mounted game pieces can arise. The limitation of a label to incorporate a single game piece may limit the attractiveness of a purchase as a game playing stratagem, for example. An additional problem that might arise with respect to repositionable game pieces in particular is that if they are detached immediately upon purchase, but prior to consumption of an article (such as a soft drink or sandwich), the game piece might be lost by the player in the packaging. A mechanism for temporarily maintaining the security of game pieces that have been inspected could largely alleviate this potential problem.

In situations in which a label is applied to a pliable as opposed to a rigid surface, or where the game piece is comparatively large, it may become temptingly easy for a party to peek at the downward or inner surface of a game piece by "bowing" or otherwise distorting the surrounding pliable material or the game piece. A mechanism for precluding manipulation of a label, a game piece, or a mounting surface to compromise the game is therefore highly desirable.

An additional problem that can arise with promotional labels and game pieces generally involves the repetition and accompanying predictability of patterns producible by conventional printing means. Typically, labels and game pieces are printed using repetitive methods such as rotary offset lithography or flexographic printing. The number and arrangement of game categories and conditions (such as award information) achievable using these methods are finite and cannot be varied. As result, combinations of categories and conditions for the game pieces, as well as the proximity of particular combinations to one another in batches of printed and processed labels, permit persons who are in a position to observe significant numbers of labels for a particular game to infer and take illegitimate advantage of such knowledge. Predictability of this kind can thus undermine the commercial value of a game.

Further security problems result from the ability of certain persons impermissibly to modify or duplicate game pieces in a manner that is difficult or impossible to detect. A mechanism for reducing or limiting these forms of cheating would therefore help to increase the value of promotional games by reducing the costs associated with cheating and fraud.

Promotional labels and game pieces also suffer from a dearth of available print-bearing space, while at the same time, players may not be sufficiently informed about the game to manipulate the pieces properly or to play the game according to the rules. The economical creation of additional "real estate" on the label or game piece for providing information helpful to players is therefore also desirable.

SUMMARY OF THE INVENTION

The present invention resolves these problems by providing a three-ply label in which the underside of the game piece or redemption panel contains a pressure-sensitive adhesive. This adhesive allows game pieces to be re-positioned by a player onto a card or other surface as a further step in playing the game. Since the adhesive face of the game piece is covered even after removal of the label, the player need not immediately attach the game piece to the card or other game surface but can delay that step, if necessary or desired. Then, at the desired time, the player can remove the backing from the game piece or redemption panel and affix it to the card or other game surface.

The three-ply label according to the present invention, like the existing two-ply label, includes a base ply. The base ply has an underside to which a pressure sensitive adhesive is applied, allowing the base ply and any additional ply coupled to the base ply to be attached to a desired surface. A second and third ply are coupled to each other with a suitable adhesive preferably along at least one preselected joining region. In a preferred embodiment, the second and third plies each have portions or "rails" extending inwardly along a pair of opposite edges along which they are adjoined by their facing surfaces, the face of the second ply being coupled to the underside of the third ply. Preselected regions of these faces that do not intersect with the "rail" regions are most preferably left free of adhesive and are instead printed with desired patterns or information, such as game information. The coupled second and third plies together are joined to the base ply in a similar manner as they are to each other. Specifically, the base ply includes preselected regions that are preferably similar in shape and placement to the rails of the second and third plies to which the underside of the second portion is fastened using an adhesive. In regions other than the preselected, adhesive-bearing regions, the top surface of the base ply may bear printed matter.

A three-ply label according to the present invention may have any peripheral geometry. Any manner or arrangement of perforations may be provided to define regions in the label that are intended to be separable from one another. Thus, for example, the rails in each of the three plies are defined at least by a perforation. In an exemplary embodiment of the label, an edge portion that is intended to be pulled by a player protrudes beyond the edge of the label in at least one location to form one or more tabs. According to the present invention, the interior angle of a vertex formed by the edge of a tab and the region of the label edge neighboring the tab should be greater than 45° and, preferably, at least about 90°. Premature tearing of the tab away from the remainder of the label is believed to be less likely under this condition. In addition, "tie" portions of perforations extending to such a vertex at which tearing is intended to be initiated are offset from the edge, permitting a certain amount of displacement of the free edge of the tab prior to the onset of tearing at the vertex. Still further, the interval between tie portions of a perforated line is preferably not uniform, but is at its highest density in the vicinity of the vertex and declines in density along the perforation in the opposite direction from the vertex.

According to another aspect of the multi-ply label of the present invention, multiple game pieces are provided in a single label. In a preferred embodiment of this aspect of the invention, but without limitation, the multiple games pieces may lie between the above-described rails and are separated from one another by at least one perforation. If, for example, two game pieces were desired, a first game piece might abut a first rail and be delineated by a first perforation along one of its edges. The parallel edge of the first game piece may join a first edge of a second game piece, from which it can be detached along a second perforation. A second edge of the second game piece, parallel to the first edge, may abut the second rail along a third perforation. Either the first or the second game piece can be individually pulled away by a player, cleaving naturally along the parallel perforations in a fashion similar to the removal of the game piece in embodiments of the invention having a single piece.

The availability of multiple game pieces with a given purchased item increases the actual or apparent possibility that a purchaser has an increased possibility of a favorable game outcome resulting from a particular purchase. In addition, with the above-described arrangement, it is easier to rupture a single perforation, either between game pieces or between a game piece and the adjacent rail, than it is to rupture a single perforation when only a single game piece is available. When a single perforation is ruptured, a player may view the play information just after purchase but prior to consuming the goods bearing the game label, and can leave the game label temporarily attached to the goods. It is believed that this decreases the likelihood of a game piece being misplaced during consumption of the goods.

According to another aspect of the present invention, adhesive is applied not only to surfaces not intended to be separated (such as in the rails), but also on surfaces to be separated including certain print-bearing surfaces. When a game piece is large, or there are multiple game pieces, or if the piece (or pieces) is (are) mounted on a flexible surface such as paper, the game is subject to being compromised by manipulating the substrate on which the label is mounted. For example, it may be possible to "bow" a paper wrapper on which the game label may be mounted to create a space sufficiently large to permit premature viewing of an inwardly-facing surface that bears play indicia.

The possibility of this sort of manipulation of game labels or the substrates on which they are mounted can undermine the integrity and thus the commercial value of the game. According to the present invention, an adhesive is applied between facing surfaces of two plies that may have been printed with play information to prevent the separation of those plies in order to form a space for premature viewing of any play information. In a preferred embodiment of this aspect of the present invention, the adhesive can be applied adjacent a centerline of a single game piece, or along the perforations between two game pieces in a label having that many pieces, or about any other locus along which a space is most easily formed or which may be structurally weakened. The adhesive should be selected from a group that is unlikely to disturb underlying printed matter, and should ideally be placed- in such a location that overlap with game information is altogether avoided. In addition, it is most preferable that some adhesive be applied as close as possible to the edge of the game label, or the ply(s) of interest, to reduce to a minimum a person's ability to peel the associated game label component at all. Although the application of adhesive is ideally in registry with the game pieces, a certain degree of latitude associated with so-called "wall paper printing" may either suffice for practical purposes or represent a justifiably economical alternative.

Prior to the present invention, game information of various sorts was only reasonably combinable in a comparatively small number of ways. The finite space on a flexographic or lithographic print cylinder restricts the number of combinations of types of information on game labels and pieces. As a result, unless impracticable measures are taken under those circumstances, game combinations can begin to grow predictable to such an extent that the game can be compromised. The present invention provides a solution to this problem by printing certain information, such as complicated patterns requiring high resolution, using offset lithographic or other high quality, high speed printing, and then printing over and in registry with the resulting printed matter using a continuously variable printing technique, such as inkjet printing. According to this aspect of the invention, certain game information may be printed rapidly and with high precision according to a regular, repeated format, while other game information can be continuously and even randomly varied. The number of available combinations of game information can be vastly multiplied in this manner, reducing predictability and accordingly enhancing the integrity and commercial value of the game.

An additional aspect of the present invention provides for printing on the top surface of the base ply. Whereas in existing labels the base ply plays a purely functional role, labels according to this aspect of the present invention may be printed on, greatly increasing the available "real estate" in the game piece. The type of information that may be advantageously printed on the top surface of the base ply includes instructions as to use of the game piece and other generic (rather than play-specific) information about the game. This information is preferably, although not necessarily, printed in registry with the base plies, rather than in "wallpaper mode," resulting in a more attractive result that is easier to read and comprehend.

A further feature of the present invention introduces benday printing on the redemption panels of game pieces. A game piece redemption panel is a part that contains information indicating that the player can exchange the part for value, such as goods or a cash award. Benday refers to background printing that can be of a sort that is difficult to reproduce faithfully. The benday printing on each redemption panel is preferably of a hue such that photocopying of the image as a whole with acceptable fidelity is impossible. A game redemption panel having benday printing makes successful tampering or color copying difficult or impossible.

It is therefore an object of the present invention to provide a promotional label having a removable game piece that a player may reposition at his or her leisure, rather than only immediately upon removal from the label.

It is another object of the present invention to provide a label having a game piece that cannot be partially pulled away from the label to permit premature viewing of play information without rupturing more than one perforation tie and thus being detached from the label to a conspicuous degree.

It is yet another object of the present invention to inhibit a person from pulling the game piece partially away from its associated label for premature viewing by at least one of the following: (1) providing a point of intended initiation of separation of a game piece from a label along a perforation forming a vertex that is greater than about 45° and that is most preferably non-acute; (2) offsetting a first perforation tie from an intended point of initiation of separation of the game piece from the label; (3) spacing perforation ties more closely to each other in a region proximate to the intended point of separation initiation than in a region distal from that point.

It is a further object of the present invention to provide multiple detachable game pieces on a promotional label.

It is still further object of the present invention to provide a game piece that may be partially detached for viewing of play information while remaining partially attached so that a player can fully detach and store the game piece at a later, desired time.

Another object of the present invention is to provide a suitable adhesive material to portions of a label having game pieces in order to separably couple surfaces intended to be detached (including print bearing surfaces) and thus to inhibit premature viewing of play indicia on the undetached game pieces.

Yet another object of the present invention is to produce game labels that are printed using both a fixed repeat method (i.e., rotary offset or flexographic printing) as well as a continuously variable printing method, such as ink jet printing or other suitable method.

Still another object of the present invention is to provide printing on the upper surface of the base ply of a game label.

An additional object of the present invention is to provide benday printing on one or more redeemable portions of game pieces detachable from a promotional label.

The various aspects of the present invention may be best understood by referring to the accompany drawings, as well as to the remainder of the text of this application.

DETAILED DESCRIPTION OF THE INVENTION

The present invention resolves the problems identified in the Background section by providing a three-ply label as described below with reference to the figures.

Figure 1A:
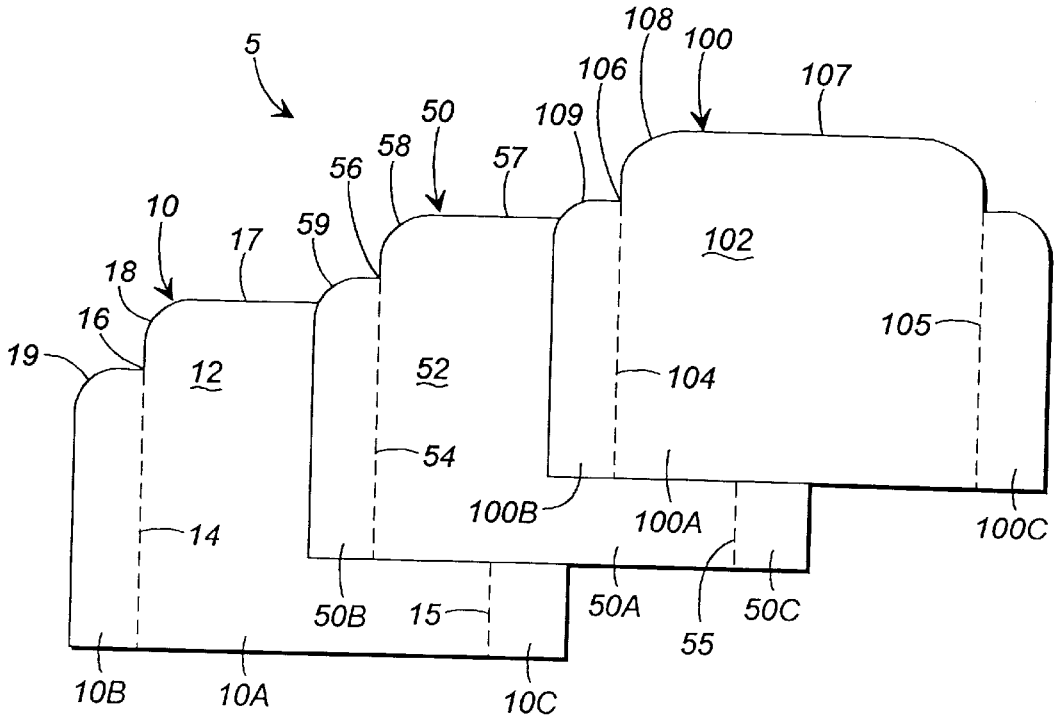
FIG. 1A shows an exploded view of a three-ply promotional label according to the present invention having a detachable game piece, in which the base ply is lowermost and the plies are viewed from above.
Figure 1B:
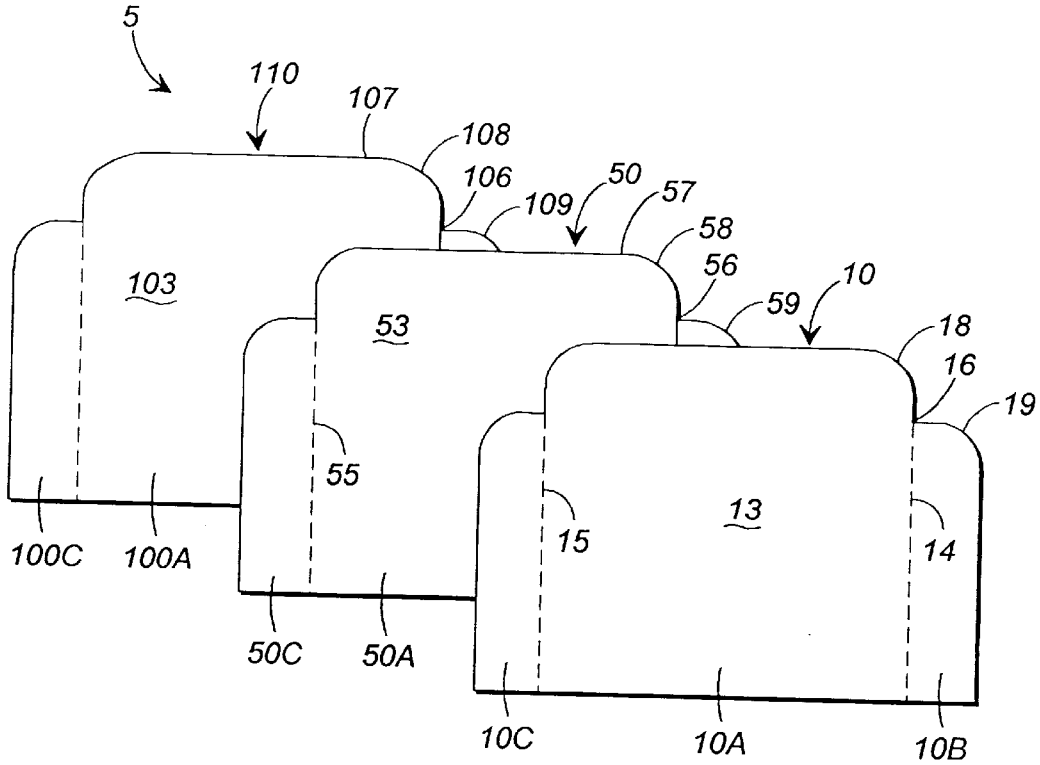
FIG. 1B shows an exploded view of the three-ply promotional label shown in FIG. 1A, in which view the base ply is uppermost and the plies are viewed from below.

FIG. 1A shows a three-ply label 5 in exploded form as viewed from above; FIG. 1B shows the same label 5, also in exploded form, as viewed from below. A first or base ply 10 is formed of a material having sufficient strength to bear additional plies and to serve to anchor those plies to a substrate surface (not shown), and to retain portions of the label 5 even upon manual removal of other portions. Base ply 10 has a face 12 and an underside 13. Underside 13 is provided with an adhesive of sufficient strength to retain it and any plies attached as described below to a temporary holding surface (from which the label 5 is eventually to be removed) and ultimately to a substrate, such as a soft drink cup, food wrapper, or other such products.

Ply 10 is divided into at least two regions. In the illustrated embodiment, ply 10 includes three portions: 10A, 10B, and 10C. These portions are delineated from adjacent portions by weakened regions, such as perforations 14 and 15. As shown in FIGS. 1A and 1B, portion 10A is distinguished and manually separable from portion 10B by perforation 14, while portion 10A is distinguished and separable from portion 10C by perforation 15. In this embodiment, the illustrated perforations and separability are optional, since the base ply, once applied, typically will not need to be separated into its component parts. The regions defined by the lines on which the perforations are made are part of the preferred embodiment of the invention, although they need not have the particular geometry shown and described.

The geometry of the periphery of base ply 10 also has certain features important for the present invention. The invention does not depend on the particular geometry shown and described, but may employ any number of external shapes or dimensions as long as they are consistent with the principles set forth in this document. In particular, the central portion 10A of base ply 10 has a periphery that includes a portion that visually distinguishes it from the label 5 as a whole. In the embodiment shown in FIGS. 1A and 1B, tab 17 of base ply 10 protrudes somewhat beyond the adjacent subsets of the edge of the label 5 corresponding to portions 10B and 10C. As described below, this distinguishable portion permits a player to identify, pull on, and detach a game piece corresponding in geometry to portion 10A and that will be adhered to portion 10A as further described below. The point at which tab 17 and portion 10A joins portion 10B of ply 5 defines a vertex 16, surrounded by the rounded corners of those portions, identified by reference numerals 18 and 19, respectively. The geometry in the vicinity of the vertex formed at the juncture of portions 10A and 10C is analogous.

Continuing with FIGS. 1A and 1B, a second ply 50 includes a face 52 and an underside face 53. The geometry of ply 50 is preferably similar and substantially equal in size to that of base ply 10. When ply 50 is laid over base ply 10, a portion 50A of ply 50 overlaps portion 10A of base ply 10. Portion 50B is set off from portion 50A by perforation 54 and overlies portion 10B of base ply 10. Likewise, portion 50C, set off from 50A by perforation 55, overlaps portion 10C. The vertex 56 and corners 58 and 59 of ply 50 are also preferably similar in geometry and size to the corresponding features of base ply 10. Specifically, a tab 57 of portion 50A protrudes beyond adjacent edge of portion 50B to form a vertex 56, surrounding which are rounded corners 58 and 59. Tab 57 similarly protrudes beyond portion 50C, preferably with substantially similar feature geometry (unnumbered) as the protrusion beyond portion 50B.

A third ply 100, like plies 10 and 50, includes face 102 and underside 103. Ply 100, moreover, comprises three portions 100A, 100B, and 100C. As is the case with components of plies 10 and 50, portions 100A and 100B are distinguished and separable from one another along perforation 104, while portions 100A and 100C are separable along perforation 105. A tab 107 of portion 100A protrudes beyond adjacent edge of portion 100B to form a vertex 106, surrounding which are rounded corners 108 and 109. Tab 107 also protrudes beyond portion 100C preferably with substantially similar feature geometry (unnumbered) as the protrusion beyond portion 100B.

Although the geometry of plies 50 and 100 preferably correspond to that of ply 10, the invention is limited neither to this particular geometry, nor to an entirely strict correspondence between all dimensions of the plies.

In order to assemble plies 10, 50 and 100 into a promotional label 5, the underside 53 of ply 50 at portions 50A and 50C is coupled by suitable means to face 12 of ply 10 respectively at portions 10A and 10C. This coupling is preferably achieved by a suitable known adhesive having sufficient strength to hold the respective portions together while nearby perforations are being ruptured. Ply 100 is coupled to ply 50 in an analogous fashion. In addition, portion 50A of face 52 of ply 50 is preferably removably coupled to underside 103 of ply 100.

When label 5 has been assembled as described, as understood by a person skilled in the art, and when underside 13 of ply 10 has been adhered to a substrate, only the free edges (unnumbered) of tabs 57 and 107 (respectively of plies 50 and 100) are capable of being grasped and pulled. When they are, perforations 54, 55, 104 and 105 rupture, permitting a game piece comprising portion 50A of ply 50 and portion 100A of ply 100 to be separated from the label 5.

Prior to assembly of plies 10, 50 and 100, underside 53 of ply 50 will have been printed with game indicia (see e.g., FIG. 9) of interest to players of the game. In addition, face 102 of ply 100 may also be printed with promotional information as well as game-related information, since this is the surface that consumers will be exposed to prior to playing the game. Further, the removable coupling of portion 50A of face 52 to portion 100A of underside 103 is preferably achieved by applying a suitable adhesive to portion 50A of face 52 and a suitable release coating to portion 100A of underside 103. Moreover, a slit (not shown) is preferably provided in portion 100A of face 102. Separation of portion 50A from portion 100A can therefore be accomplished by grasping 100A at the slit and pulling, exposing the sticky, adhesive-bearing face 52 (of portion 50A). It is this desideratum that constitutes the redeemable portion of the label 5 and that can be re-positioned to a card or other object (not shown) for collecting game pieces.

Premature viewing of game indicia on underside 52 may be inhibited according to configurations of a promotional label 5 (of the sort illustrated in FIGS. 1A and 1B) illustrated in and described with reference to FIG. 2. In that figure only face 102 of ply 100 is visible and the discussion will refer to parts of that ply; however, the discussion applies at least to ply 50 as well, and its analogous parts, since portions 50A and 100A of those plies are detached together as a game piece in the illustrated embodiment.

Figure 2:
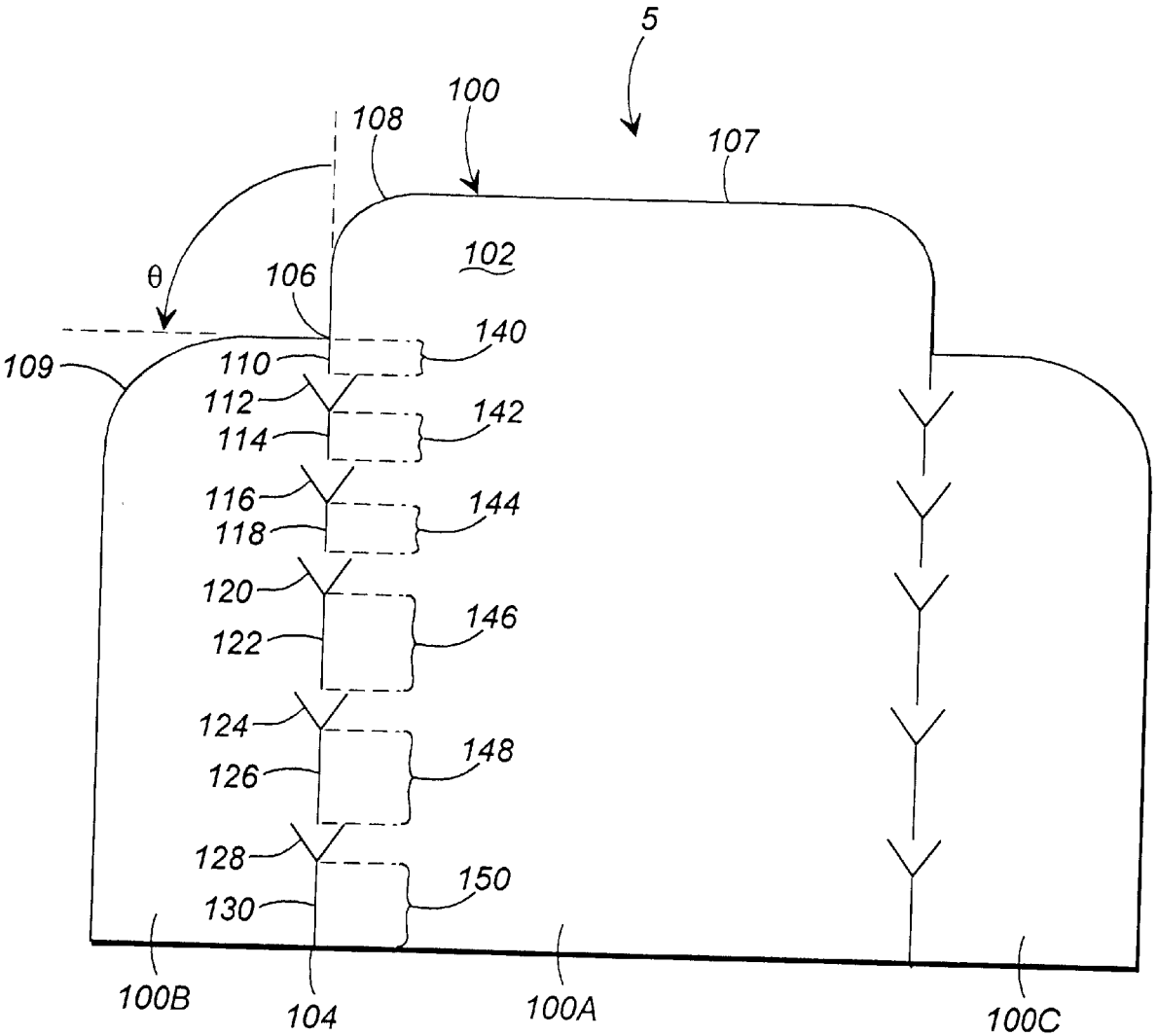
FIG. 2 shows the assembled three-ply promotional label shown in FIGS. 1A and 1B indicating certain angular and linear dimensions of the periphery and perforations of the label according to the present invention.

Three mechanisms for inhibiting or precluding the pulling or peeling back of a game piece are illustrated in FIG. 2 and described in the following text. For convenience, only the juncture of portion 100A and portion 100B is referred to, but the discussion is equally applicable to the juncture of portion 100A with portion 100C, or, more generally, for any juncture between portions of a promotional label such as label 5 that are to be separated along a weakened region.

A first mechanism for inhibiting pulling or peeling back a game piece for premature viewing of game indicia involves the selection of the angle for vertex 106, where the periphery of portion 100A joins the periphery of supporting portion 10B. The vertex 106 is the intended point at which the rupture of perforation 104 is to be initiated. Rather than select the angle of this vertex to be severely acute, for example less than or equal to approximately 45°, the present invention recognizes that angle θ for vertex 106 is preferably preselected to be greater than this value. Most preferably, and approximately as shown (although not necessarily), the angle θ is at least about 90°. It is believed that an angle greater than a severely acute angle, and particularly at least in the vicinity of 90°, increases the force at vertex 106 due to pulling tab 107 that is necessary to initiate rupture at that point. In addition to tending to inhibit intentional pulling or peeling at tab 107, this and the other two features of the invention discussed below having to do with separation along the perforation tend to reduce the likelihood of accidental rupture of the perforation due to handling of objects bearing a promotional label 5.

The second and third mechanisms for inhibiting premature pulling or peeling away of a game piece involves the geometry of the perforation 104. Rather than provide a perforation "tie" immediately adjacent to vertex 106, this aspect of the present invention provides a weakened portion 110 of perforation 104 at that point. A perforation typically includes weakened or fully perforated portions (collectively called "weakened portions" in this document) that alternate with intact or "tie" portions, which provide the primary (or total) resistance to separation along the perforation. It is believed that the placement of a weakened portion 110 rather than a tie portion (such as 112) immediately adjacent vertex 106 provides a measure of relief or "give" if tab 107 is subject to intentional or accidental pulling or peeling. If a tie were present instead, and the tie were ruptured, that fact might not be noticeable, but would permit peeling tab 107 back to such a degree as possibly to admit viewing of game indicia on underside 53 of portion 50A of ply 52.

In addition, the present invention does not distribute weakened portions and ties of perforations uniformly. Rather, in the perforation 104 of label 5, it is preferable that the lengths 140, 142, and 144 of at least one weakened portion of the perforation proximal to the vertex be shorter than at least one of the lengths 146, 148, and 150 of the weakened portions distal to the vertex. Referring to FIG. 2, weakened portions 110, 114 and 118, proximate to vertex 106, are shorter than weakened portions 122, 126 and 130 distal to the vertex. Tie portions, such as 112, 116, 120, 124 and 128 are shown as being approximately equal along perforation 114; however, this is not necessary and indeed the same beneficial effect as described above might be achieved if the tie portions were to be made longer in the region proximate to vertex 106 than in the region distal to it. It is believed that shorter weakened portions (e.g., 110, 114, 118) increase the force on tab 107 necessary to propagate a rupture along perforation 104, and do so in a region where that increase in rupture strength is most necessary.

Figure 3:
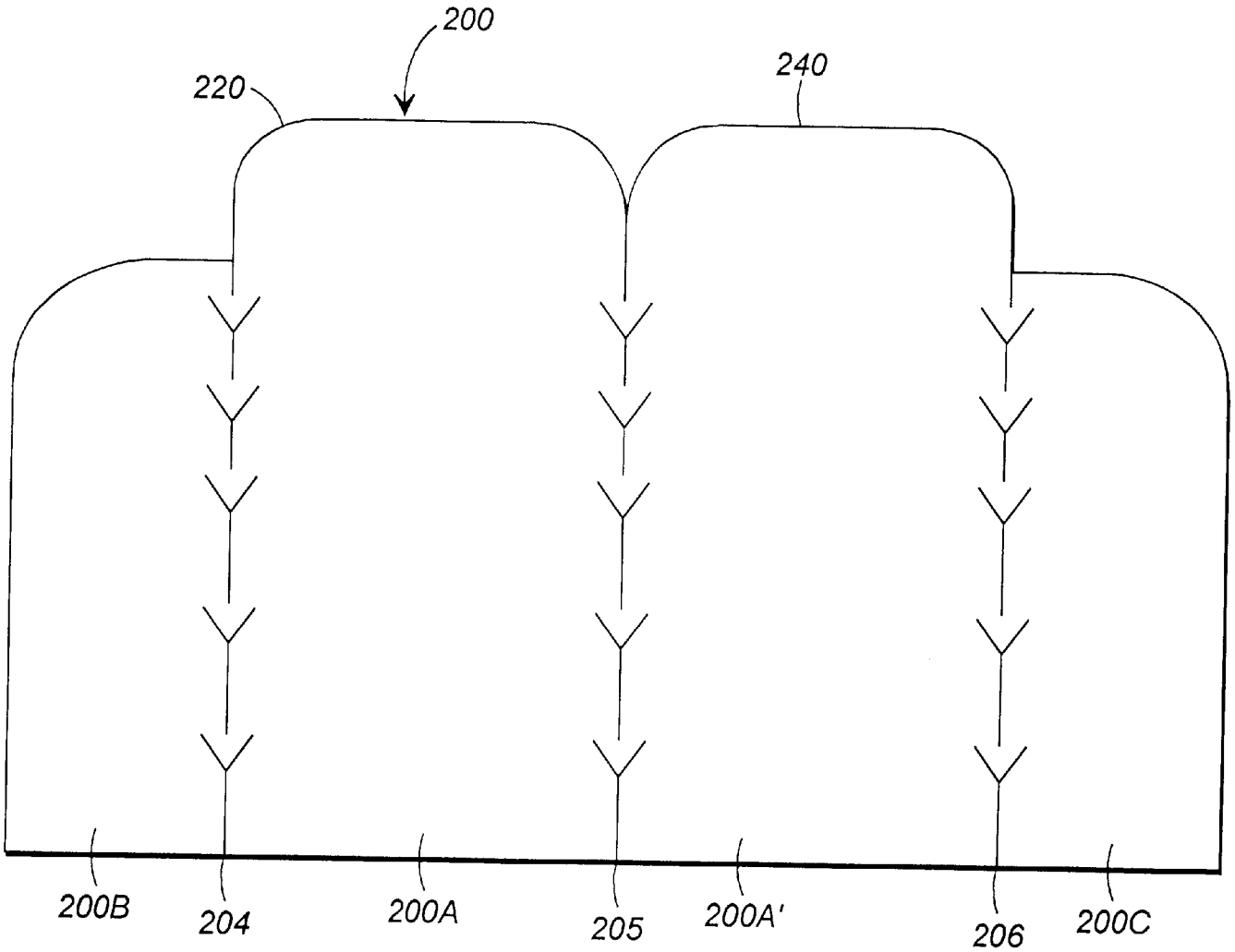
FIG. 3 shows a promotional label according to the present invention having multiple game pieces.

Referring now to FIG. 3, a promotional label 200 having multiple game pieces (in this case two) is shown. The horizontal dimension of a portion corresponding to portion 100A of the embodiment of the label shown in FIGS. 1A, 1B and 2 may be increased to provide the resultant game pieces 200A and 200A' with sufficient lateral dimension to bear significant game indicia on their respective undersides (not shown). The formation of a promotional label 200 according to this aspect of the present invention begins in a manner analogous to that described in the text accompanying FIGS. 1A, 1B and 2, above, resulting in a label having portion 200B formed by perforation 204 and portion 200C formed by perforation 206. In addition, however, a further perforation 205 is provided to demarcate the line of separation between game pieces.

Figure 4:
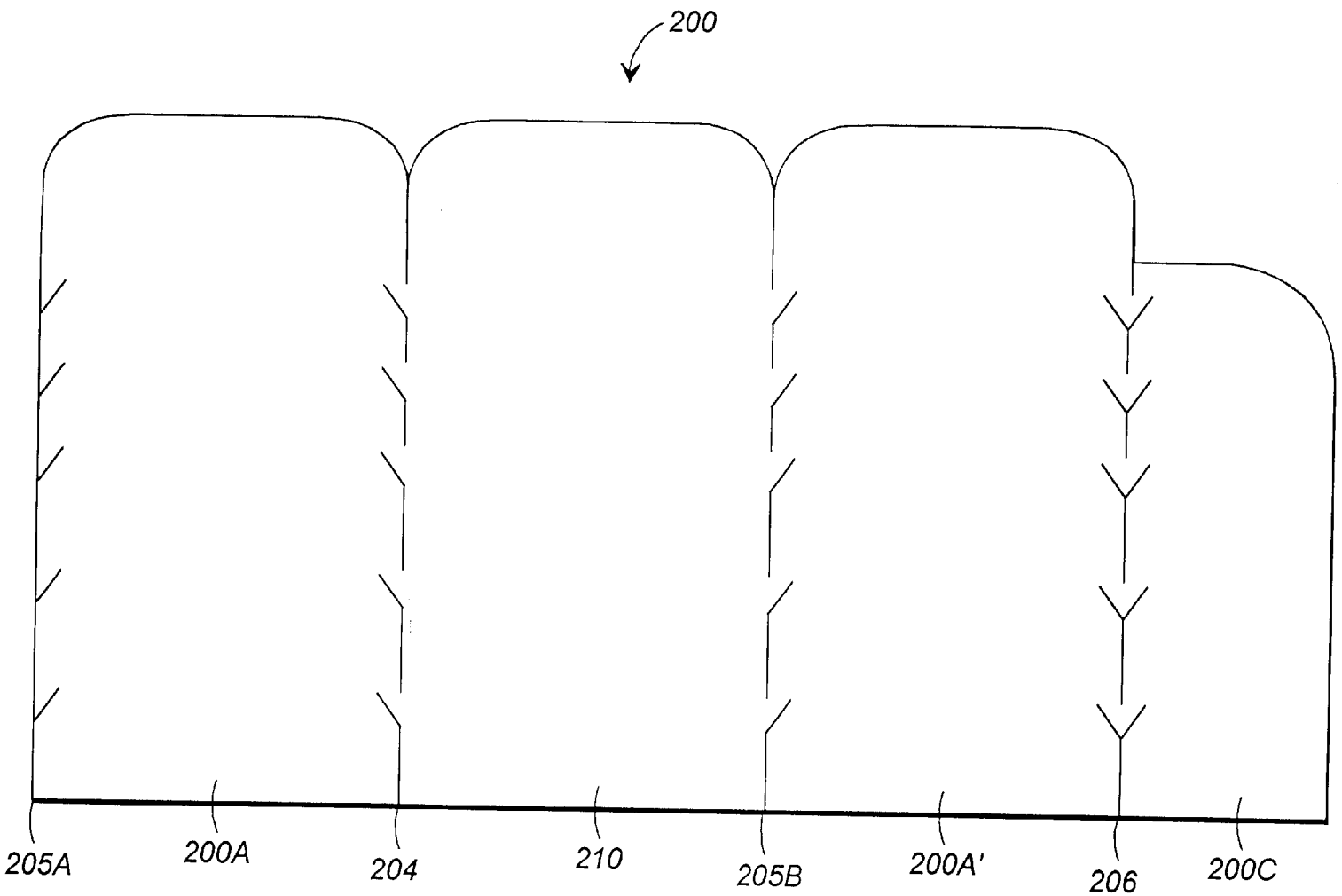
FIG. 4 shows the promotional label of FIG. 3 having multiple game pieces, in which the left of the two game pieces shown has been detached from the second game piece, but has been left intact along the perforation connecting it with an adjacent rail of the label, which supports the label until complete detachment is desired.

A product bearing a promotional label having multiple game pieces is likely to be more attractive to a consumer than one having a single game piece because of the increased actual or apparent likelihood of acquiring a redeemable game piece or combination of game pieces. In addition, however, the game pieces are of somewhat greater practical value since they are easier for a consumer to keep track of following an initial inspection of the game indicia. Referring to FIG. 4, when a product bearing a multiple game piece promotional label 200 (such as a soft drink or a hamburger) is purchased, the purchaser is likely to be interested in examining the game indicia on the game pieces as soon as possible after the purchase. Naturally, and particularly where the product bearing the label contains food, the purchaser, having inspected the game pieces, also will be interested in consuming the product. Where a label having a single game piece is concerned, though, the game piece as a practical matter must be completely disengaged from the remainder of the label. At that point, the consumer must keep track of a fully detached, and possibly quite small, game piece. If the label were a two-ply label, the game piece—having a sticky exposed side—could quite possibly become inadvertently stuck to another object. Even if the label were a three-ply label as described above in connection with FIGS. 1A, 1B and 2, the comparative minuteness of the game piece may lead to its being "lost in the shuffle" before the purchaser is able to devote sufficient attention to keeping track of it.

The present invention provides a solution to this problem, in that it is considerably more easy to rupture a multiple game piece label along a single perforation than it is to do so with a label having a single game piece. Rupture along a single perforation permits rotation of the game piece about the intact perforation. As shown in FIG. 4, game piece 200A, the right side of which was freed by the rupture of perforation 205 (of FIG. 3) into halves 205A and 205B, can pivot about perforation 204, which may remain intact. The purchaser can thus view game indicia on game piece 200A (or on 200A'), and can leave that game piece intact to the label until a later time, when careful storage of the game piece may be more convenient.

The multiple game piece embodiment of this aspect of the present invention is not limited to including two game pieces, but may include any practicable number of them made according to the general principles described above. In addition, the multiple game piece embodiment does not depend on the labels and game pieces having three plies, but may also be employed for labels and game pieces having two plies.

For apparently the same reasons that multiple game piece labels are easier to rupture along a single perforation, it is believed that such labels are easier to violate by "bowing" or otherwise manipulating the label to create a space sufficient to permit viewing of game indicia. This problem is exacerbated by the placement of a promotional label on a pliable material, such as the sandwich wrapper, a newspaper page, or the like, since the pliable substrate may be more easily manipulated to create the viewing space.

Figure 5:
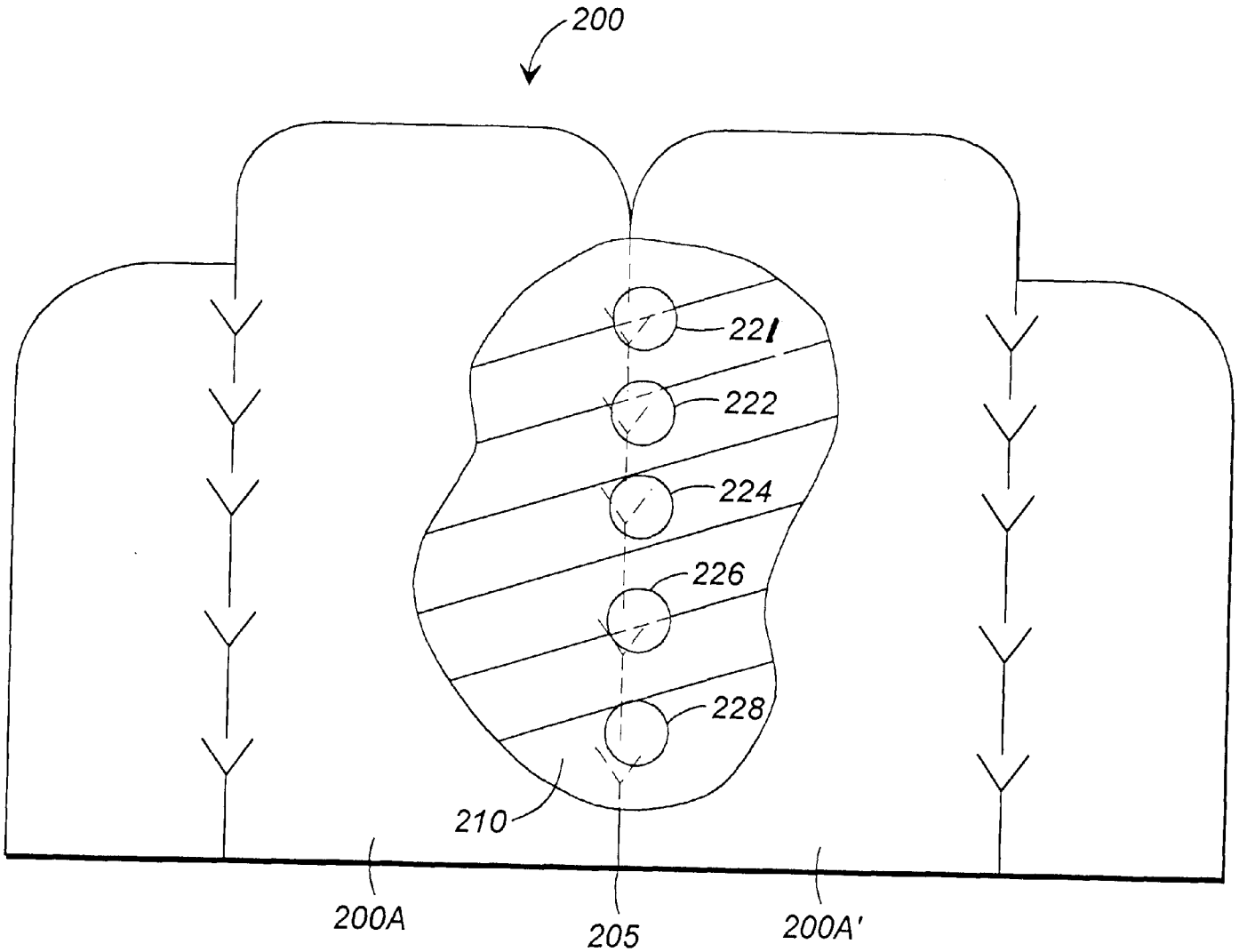
FIG. 5 shows a partially cut-away view of the promotional label of FIG. 3 having multiple game pieces, the second and third plies having been partially cut away to reveal adhesive on the upper face of the base ply.

To overcome this problem, as shown in FIG. 5, another embodiment of the present invention applies an adhesive (drops 221, 222, 224, 226 and 228) to couple the game-indicia-bearing surface of game pieces 200A and 200A' to the face 210 of the corresponding base ply (as seen in the cut-away of the illustrated three-ply label). Although the surfaces are intended to be separable, suitable adhesives exist that are capable of holding adjacent sheets together, but which form a bond weaker than that provided by the perforation and that do not remove any portions of the sheets to which the adhesive is applied. The adhesive is preferably applied in the vicinity of perforations, at which the danger of impermissibly peeking at game indicia is greatest. In addition, the adhesive preferably should be applied away from text, particular the text on game pieces, since it may tend to make such text difficult to read. The adhesive does not need to be applied in the form of discrete droplets linearly applied only in the direction of the perforation, as shown, but could be applied in any other suitable manner.

Figure 6:
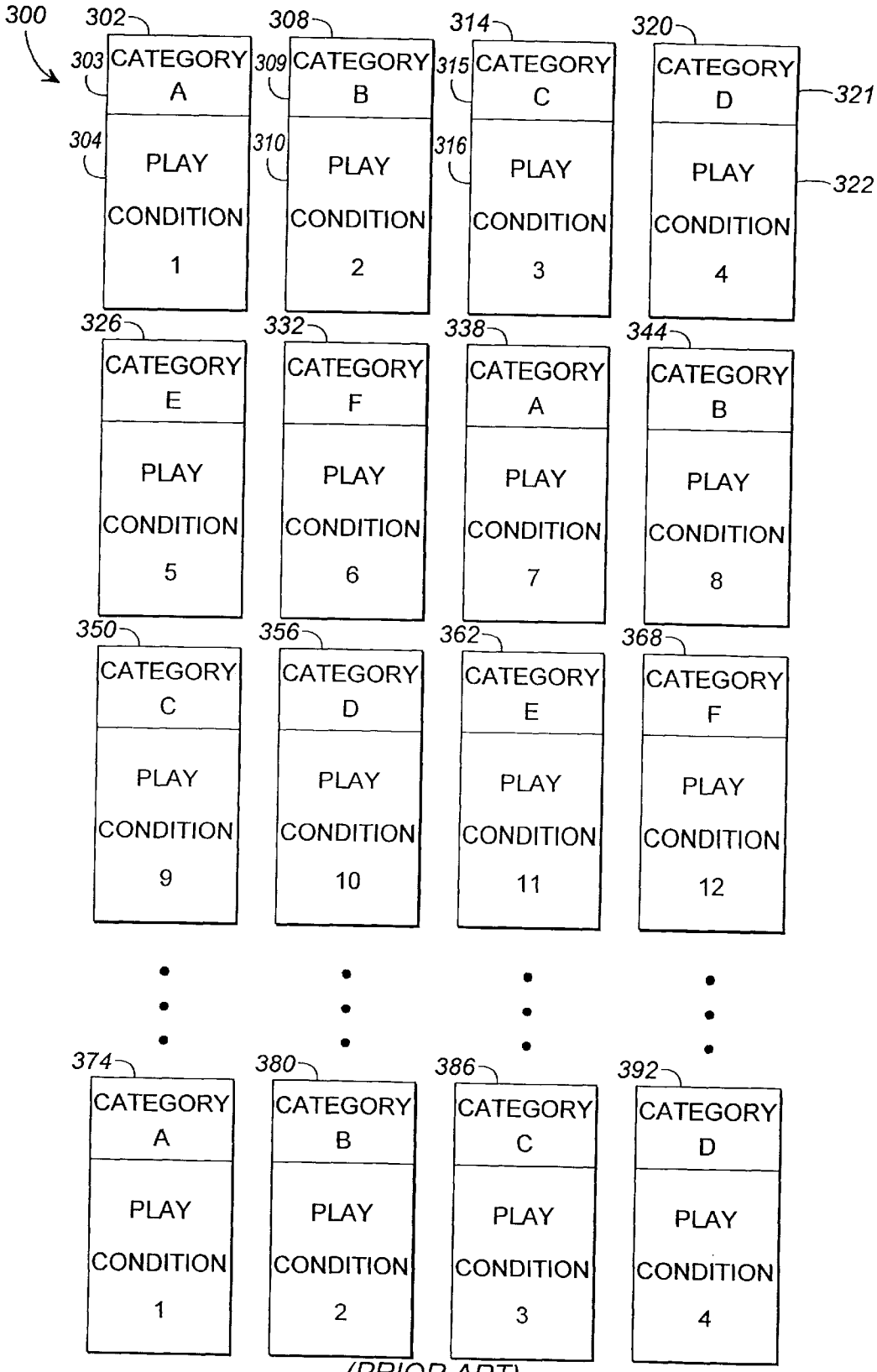
(PRIOR ART) FIG. 6
FIG. 6 shows part of a web of printed game pieces for promotional labels produced according to known methods, all indicia subject to periodical repetition and predictability.

Another aspect of the present invention is directed to a security feature respecting factors other than physical manipulation of the promotional labels. Referring to FIG. 6, a grid 300 of game indicia is shown as would appear on a web that has emerged from a rotary offset lithographic or a flexographic printing press only a portion of such a web is shown, and the game indicia are of a known variety printed according to known techniques.

Each element of the grid 300 of game indicia (which corresponds to a particular game piece) includes at least two fields. Referring to element 302 of grid 300, it includes: (1) field 303, in which may be printed categorical game information (e.g., identifying information regarding sets or classes of interest in the game); and (2) field 304, in which may be printed conditional information (e.g., regarding play of the game), such as outcomes, redeemable subject matter, etc. The top row of grid 300 includes elements 302, 308, 314 and 320. The respective fields containing categorical information 303, 309, 315 and 321 contain information "A," "B," "C" and "D," respectively. The conditional fields 304, 310, 316 and 322 of the same elements respectively contain information "1," "2," "3," and "4." Subsequent rows, such as the second row (containing elements 326, 332, 338 and 344) or the third (containing elements 350, 356, 362 and 368) can be seen to contain combinations of categorical and conditional information different from that in the first row. Element 356, for instance, includes categorical information "D" and conditional information "10," a combination different from those in previous rows.

Nevertheless, according to known methods, the printing of this information is performed by a mechanism that is inherently repetitive. As a consequence, even if the size of the elements is small compared to the dimensions of the corresponding printing cylinder (not shown), combinations of information will eventually be repeated. The fourth indicated row (containing elements 374, 380, 386 and 392) can be seen to be identical to those in the first row. Moreover, patterns of combinations will occur that are susceptible of detection by a practiced eye. Such detectability can compromise a promotional game.

Figure 7:
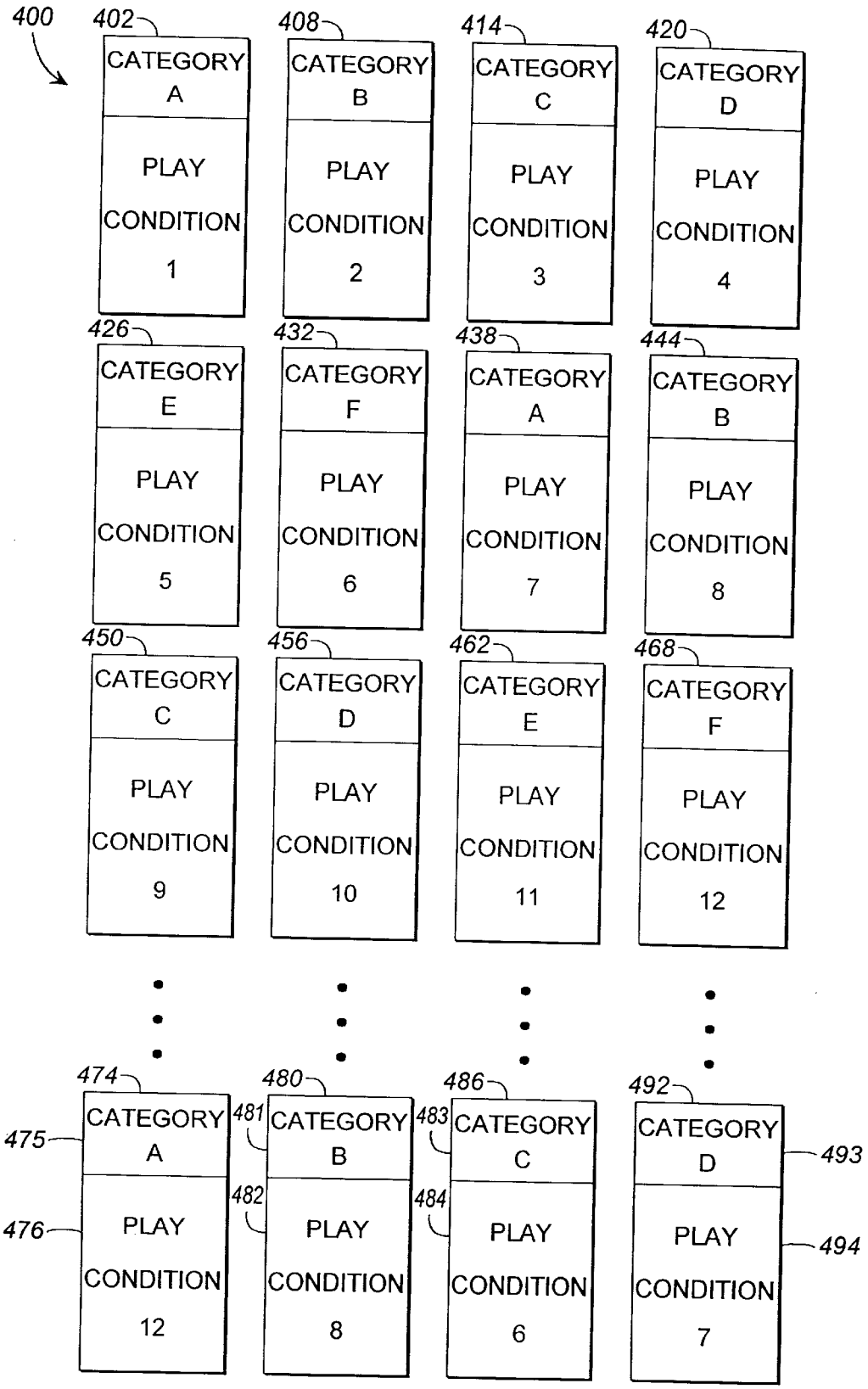
FIG. 7 shows part of a web of printed game pieces for promotional labels according to the present invention, in which certain indicia may be varied as desired and repetition and predictability of indicia are avoided.

The present invention provides a solution to the foregoing problem. Referring to FIG. 7, the first three rows of elements of grid 400 (containing, respectively, elements: (1) 402, 408, 414 and 420; (2) 426, 432, 438, and 444; and (3) 450, 456, 462 and 468) are seen to include information identical to that contained in the first three rows of grid 300. Rather than print all the information in elements using inherently repetitive printing methods, the present invention recognizes that not all the game indicia must be printed using inherently repetitive methods. Rather, this aspect of the invention is based on the recognition that while certain indicia, carrying information of a more categorical nature such as indicia 475, 481, 483, and 493 respectively on elements 474, 480, 486, and 492, can be repeated with a fixed pattern, other indicia, carrying information of a more conditional character such as indicia 476, 482, 484, and 494 respectively on elements 474, 480, 486, and 492, is preferably varied. In addition, the present invention embodies the recognition that the former types of indicia lend themselves more fully to the benefits of rotary offset lithography, for example, including high resolution, complicated, multicolored images. Conditional information, on the other hand, would tend to include information more suitable for text (such as information having to do with the identity of certain game outcomes, indications of cash awards, etc.) and therefore is suitable for application by lower resolution methods.

In general, the present invention teaches the printing of game indicia in part using repetitive printing methods and in addition using a variable printing method, such as ink jet printing. More specifically, the present invention provides a method for printing promotional game pieces, in which each game piece includes at least one field preselected for receiving indicia that are categorical in nature and also includes at least one field preselected for receiving indicia that are conditional in nature. Indicia representing information that is categorical in nature are printed in the corresponding preselected field(s) using a repetitive printing process. Indicia representing information that is conditional in nature is printed in the corresponding preselected field(s) using a variable printing process (such as ink jet printing), the variable printing being in registry with the repetitive printing.

Figure 8:
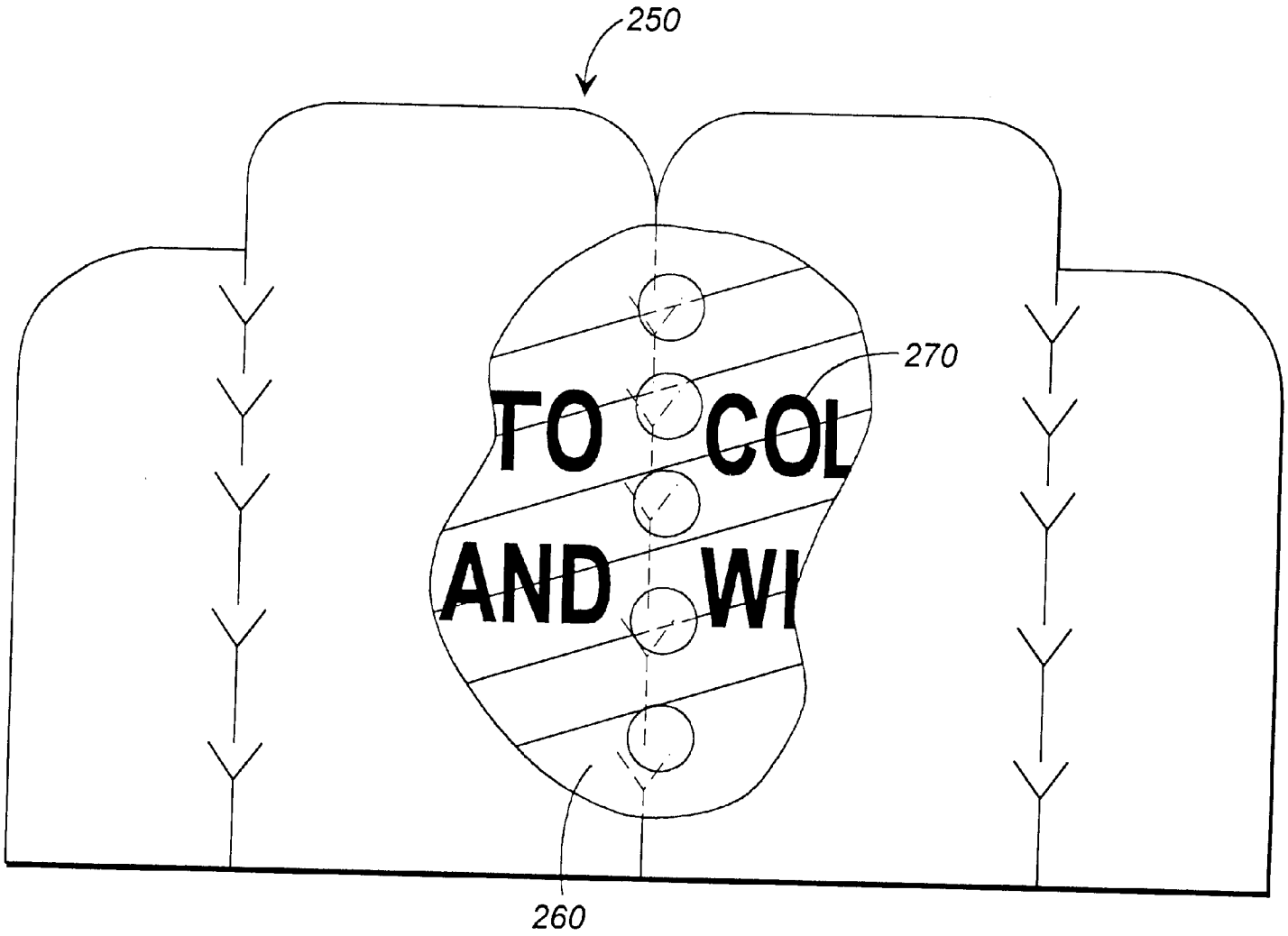
FIG. 8 shows a partially cut-away view of a multi-ply promotional label similar to that of FIG. 5, but in which the upper face of the base ply has been printed.

Another aspect of the invention having to do with printing on game pieces is illustrated in FIG. 8. That figure shows a game piece of the general sort shown in FIGS. 3, 4 and 5. In the embodiment of FIG. 8, game piece 250 is shown in a cut-away view in which the face of base ply 260 is visible, and includes printed matter 270. No prior examples of printing upon the face of a base ply of competitive promotional game pieces are known. However, there has been a long felt need for additional space on labels and game pieces on which to print information to assist players of the game. Preferably, the face of base ply 260 is printed with instructional matter directing the player as to the proper use of the game piece whose removal has revealed such printing.

Figure 9:
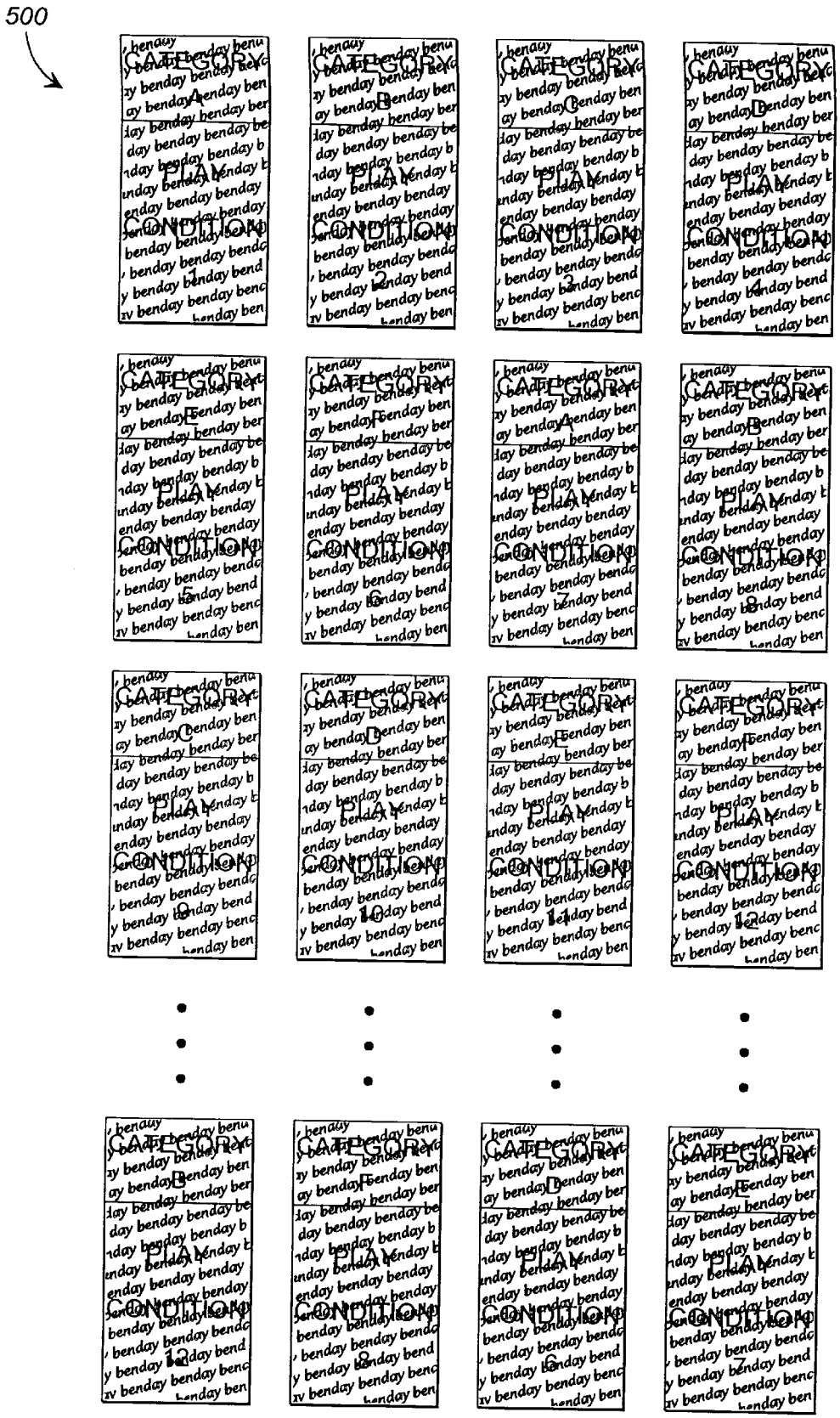
FIG. 9 shows part of a web of printed game pieces similar to that shown in FIG. 7, but in which the pieces have been background-printed with a benday pattern.

A final aspect of the present invention is also directed to printing upon game pieces, but is directed to the solution of the problem of impermissibly copying or modifying game indicia. Referring to FIG. 9, a game indicia grid 500 similar to that shown in FIG. 7 is shown. According to the present invention, the background to the game indicia has been printed with a benday pattern. The purpose of a benday pattern in this context is to provide a pattern of such minuteness, detail or lightness that modification or reproduction of a game piece is rendered impossible or impracticably difficult. Although the benday of FIG. 9 repeats the very term "benday" for purposes of illustration, that pattern can be any desirable pattern, including trade and service marks, or information pertaining to the game. In addition, the benday pattern may be of any color, but should be sufficiently light to make copying difficult, and is preferably also of a hue that is difficult to photocopy.

Although the various aspects of the present invention have been described in the context of particular illustrated embodiments, the invention, as set forth in the appended claims, is not limited by those embodiments, or by their description in this document.

What is claimed is:

1. A method for printing a grid of promotional game pieces on a web, each game piece including at least a first and second type of indicia, the second type of indicia indicating game outcomes, the method comprising:

printing the first type of indicia on the grid of game pieces formed on the web using a repetitive printing process;

printing the second type of indicia on the grid of game pieces formed on the web using a variable printing process; and the variable printing process registering with the repetitive printing to form combinations of first indicia and second indicia, the variable printing process selectively placing the second indicia on the grid with the first indicia;

wherein the resulting promotional game pieces are printed in a manner that is not repetitive and that inhibits prediction of game outcome.

2. A method for printing a grid of promotional game pieces on a web, each game piece including at least one field preselected for receiving indicia that are categorical in nature and also including at least one field preselected for receiving indicia that are conditional in nature, the method comprising:

printing the indicia that are categorical in nature in the corresponding at least one preselected field on the promotional game pieces on the web using a repetitive printing process; and printing the indicia that are conditional in nature in the corresponding at least one preselected field on the promotional game pieces on the web using a variable printing process, the variable printing being in registry with the repetitive printing;

wherein the resulting promotional game pieces include fields of higher resolution associated with a repetitive printing process than a resolution of the indicia of the conditional nature printed using the variable printing process, but the indicia as a whole are printed in a manner that is not repetitive and that inhibits prediction of game outcomes.

3. The method of claim 2, in which the game piece further includes at least one preselected field for printing a benday pattern, which preselected benday field intersects with other fields of the game piece, the method further comprising:

printing the benday pattern in the at least one corresponding preselected field using a repetitive printing process.

4. The method of claim 3, in which the repetitive printing process is a rotary offset lithographic process.

5. The method of claim 3, in which the repetitive printing process is a flexographic printing process.

6. The method of claim 2, in which the repetitive printing process is a rotary offset lithographic process.

7. The method of claim 2, in which the repetitive printing process is a flexographic printing process.

8. The method of claim 2, in which the variable printing process is an ink jet printing process.

* * * * *

UNITED STATES PATENT AND TRADEMARK OFFICE

CERTIFICATE OF CORRECTION

PATENT NO. : 6,272,991 B1
DATED : August 14, 2001
INVENTOR(S) : Benny R. Rich et al.

It is certified that error appears in the above-identified patent and that said Letters Patent is hereby corrected as shown below:

Column 8,
Line 53, delete "10B" and insert -- 100B --

Column 11,
Line 3, delete "press only" and insert -- press. Only --

Signed and Sealed this

Ninth Day of April, 2002

*Attest:*

*Attesting Officer*

JAMES E. ROGAN
*Director of the United States Patent and Trademark Office*

US006272991C1

(12) EX PARTE REEXAMINATION CERTIFICATE (7482nd)

United States Patent

Rich et al.

(10) Number: US 6,272,991 C1

(45) Certificate Issued: May 4, 2010

(54) METHOD FOR PRINTING A MULTI-PLY LABEL

(75) Inventors: Benny R. Rich, Oakwood, GA (US); Mark D. Davis, Alpharetta, GA (US)

(73) Assignee: The CIT Group/Business Credit, Inc., Atlanta, GA (US)

Reexamination Request:
No. 90/009,262, Aug. 25, 2008

Reexamination Certificate for:

| | |
|---|---|
| Patent No.: | **6,272,991** |
| Issued: | **Aug. 14, 2001** |
| Appl. No.: | **09/339,698** |
| Filed: | **Jun. 24, 1999** |

Certificate of Correction issued Apr. 9, 2002.

Related U.S. Application Data

(62) Division of application No. 08/514,298, filed on Aug. 11, 1995, now Pat. No. 5,944,355.

(51) Int. Cl.
*G09F 3/02* (2006.01)

(52) U.S. Cl. ..... 101/485; 101/490

(58) Field of Classification Search ..... None
See application file for complete search history.

(56) References Cited

U.S. PATENT DOCUMENTS 4,554,869 A * 11/1985 Ranno, Sr. ..... 101/145
4,858,123 A 8/1989 Alexoff et al.
5,143,362 A * 9/1992 Doane et al. ..... 270/1.03
5,542,710 A 8/1996 Silverschotz et al.

OTHER PUBLICATIONS

Pizza Hut "Search for the Missing Microfilm" game pieces.
McDonald's "McMillions on NBC" promotion.

* cited by examiner

*Primary Examiner*—Margaret Rubin

(57) ABSTRACT

A multi-ply promotional label having a detachable game piece according to the present invention includes peripheral and perforation geometry that reduces the likelihood of intentional or inadvertent premature viewing of game indicia on the detachable piece. The label, moreover, may include multiple detachable game pieces. Deleterious effects of increased tensile stress along perforations due to the presence of multiple detachable game pieces or other factors are overcome by applying an adhesive to removably couple a preselected region of a downwardly facing aspect of a detachable game piece to an underlying base ply. The upward face of the same base ply may be printed to increase the available printable area in order, for example, to further instruct players on game procedures. Game security is enhanced and other advantages are provided by printing preselected fields containing categorical game indicia using a repetitive printing process and printing in registry therewith preselected fields containing conditional game indicia. In contrast to known processes, resulting game pieces can be produced having no predictability.

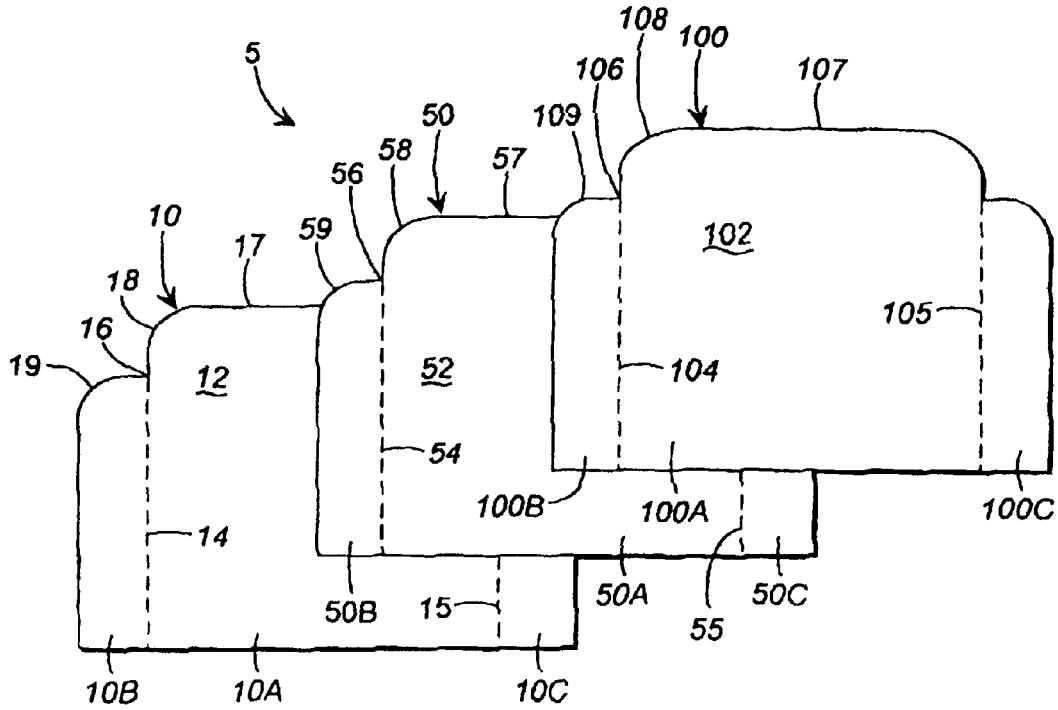

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19 are cancelled.

* * * * *